United States Patent [19]

Diebold

[11] 4,115,99

[45] Sep. 26, 197

[54] USE OF HIGH ENERGY PROPELLANT IN GAS GENERATORS

[75] Inventor: James P. Diebold, Ridgecrest, Calif.

[73] Assignee: The United States of America as represented by the Secretary of the Navy, Washington, D.C.

[21] Appl. No.: 558,194

[22] Filed: Mar. 13, 1975

[51] Int. Cl.[2] ..... C06D 5/06

[52] U.S. Cl. ..... 60/219; 60/205; 102/103; 149/19.1; 149/19.4; 149/19.5; 149/19.9; 149/20; 149/44

[58] Field of Search ..... 149/11, 19.1, 19.4, 149/19.5, 19.9, 20, 44; 102/103; 60/205, 219

[56] References Cited

U.S. PATENT DOCUMENTS

| | | | |
|---|---|---|---|
| 2,990,683 | 7/1961 | Walden | 149/19. |
| 3,677,010 | 7/1972 | Fink et al. | 149/19. |
| 3,679,781 | 7/1972 | Olson et al. | 149/1 |
| 3,743,554 | 7/1973 | Mellow | 149/1 |

*Primary Examiner*—Leland A. Sebastian

*Attorney, Agent, or Firm*—R. S. Sciascia; Roy Miller; Lloyd E. K. Pohl

[57] ABSTRACT

Thin pieces of high energy propellant are potted in a potting material such as isocyanates cured hydroxy terminated polybutadiene, hydroxy terminated polybutadiene, polyurethane, polyester or polysulfide so that they will primarily end burn. The result is a composite structure that can be used to produce cool gases suitable for use in gas generator applications.

3 Claims, 2 Drawing Figures

USE OF HIGH ENERGY PROPELLANT IN GAS GENERATORS

BACKGROUND OF THE INVENTION

1. Field of the Invention

This invention relates to materials for use in gas generator applications.

2. Description of the Prior Art

In the prior art, special propellants have been used in gas generator applications. These special propellants have been specialty items and, therefore, expensive. Special propellants have been necessary because of the fact that, in gas generator applications, cool gases, i.e., gases which will not harm the generator housing, are required.

SUMMARY OF THE INVENTION

Figure 1:
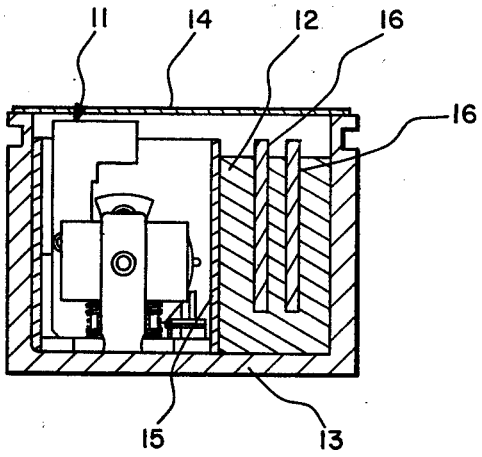
FIG. 1 is a cross-sectional view of a gas generator containing a composite gas generating material according to this invention.

It has now been found that common, readily available, high energy, solid rocket propellants can be used in gas generators in spite of the fact that such propellants burn with flame temperatures which are much too high to be ordinarily practical in gas generator applications. To use high energy solid rocket propellants, thin strips, sheets or strands of the solid propellant material are potted in potting materials such as isocyanate cured hydroxy terminated polybutadiene and others hereinafter mentioned. When the strips, sheets or strands burn, the local flame temperature is very high. However, because the strands have a large surface-area to volume ratio, a large percentage of the heat produced by them is absorbed by the potting material heating up and decomposing to form additional gases. This results in a relatively cool, lowly corrosive gas mixture.

DESCRIPTION OF THE PREFERRED EMBODIMENT

In one specific gas generator application, it was desired to use gases produced by the gas generator to rupture seal diaphragms and then to expel two components of a chemiluminescent system and mix them. A gas generator of the type shown in FIG. 1 and 2 of the drawing was used. The gas generator had an igniter assembly 11, high energy propellant slabs 16, and a potting material 12 enclosed within a cup 13 and seal 14. The gas producing material (12 and 16) was separated from the igniter assembly by a partition 15.

The igniter assembly forms no part of this invention other than the fact that it ignites the gas generator propellant. Since any well known, readily available igniter assembly could be used, no detailed description of the igniter assembly is needed here.

The gas producing material, used in the above-mentioned specific application, was made up of four 0.1 inch thick sheets or slabs of high energy, solid rocket propellant 16 embedded in and held in place by a potting material 12. In the specific application mentioned above, the potting material 12 was hydroxy terminated polybutadiene cured with a stoichiometric amount of toluene di-isocyanate. The high energy propellant 16 was 14 weight percent cured carboxy terminated polybutadiene, 69 weight percent ammonium perchlorate, and 17 weight percent aluminum. However, it is to be realized that other materials such as hydroxy terminated polybutadiene, polyurethanes, polyesters, polysulfides, and many more could be used as the potting material and that many other well known, readily available high energy propellants such as those containing a fuel selected from the group consisting of aluminim, magnesium, carbon, etc.; a oxidizer selected from the group consisting of ammonium perchlorate, ammonium nitrate, cyclotetramethylenetetranitramine (HMX), or cyclotrimethylenetrinitramine (RDX); and a binder selected from the group consisting of polybutadienes (either hydroxy or carboxy terminated) polyurethanes, polyesters, fluorocarbons, polysulfides or nitroglycerin-nitrocellulose, etc. could be used.

Figure 2:
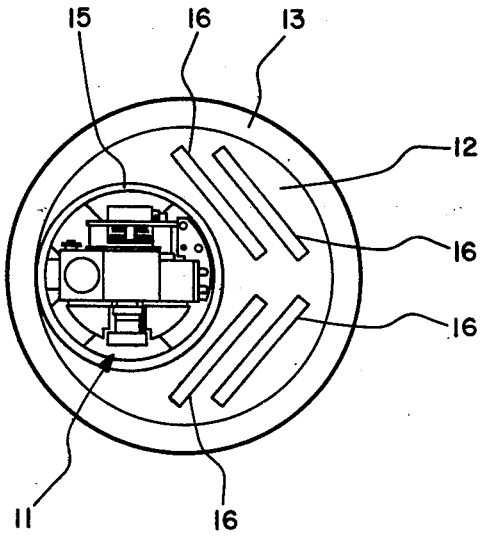
FIG. 2 is a view looking down into the gas generator of FIG. 1.

In examining FIG. 1 of the drawing, it will be noted that the high energy propellant sheets 16 were located in the composite in a way such that, when ignited, they primarily end burned. That is, they were ignited at the ends which are shown protruding slightly above the potting material and primarily end burned toward their opposite ends. Only a small protrusion of a few hundredths of an inch is necessary to start the sheets end burning. It was found that, with this arrangement, when the sheets of high energy propellant burned, much of their exceedingly high flame temperature (as compared to the low flame temperature of conventional gas generator propellants) was absorbed by the surrounding potting material as it heated up and decomposed.

In the drawing, the high energy propellant material 16 is shown as sheets or slabs. Strands or other geometrical shapes can be used in lieu of the sheets shown.

Burn time and the amount of gas produced can be adjusted in composite gas generator propellants of the type contemplated by this invention by adjusting the length and width of the high energy propellants. More or less than the four sheets shown may be used. Chemical equilibruim calculations for flame temperatures indicated that not more than about 50 weight percent of the total gas producing material should be high energy propellant. Pieces of high energy propellant should preferably, be at least 0.05 inch from one another in the composite structure of the gas producing material.

In addition to the above-described specific use, i.e. mixing chemiluminescent components, gas generators utilizing propellants according to this invention can be used for any of the other purposes that gas generators are commonly used for. That is, they may be used to push pistons, expel liquids for liquid rocket motors and flame throwers, expel flares, and to expel ballast and the like in underwater recovery systems. Gases produced by this invention are not hot enough to damage aluminum hardware and the like.

Composite structures wherein pieces of high energy propellant are potted in potting materials can, of course easily be made up by (1) making up solid pieces of the high energy material, (2) placing them at desired locations in uncured potting material and then (3) curing the potting material.

What is claimed is:

1. In a method for doing work wherein a gas generating material within a housing is ignited and burned to produce a gas which does said work without damaging said housing by means of heat, the improvement residing in utilizing as said material a composite consisting essentially of a potting material and one or more pieces of conventional solid rocket propellant potted in said potting material in a way such that said pieces will primarily end burn when ignited and will endothermically pyrolyze sufficient potting material to lower the flame temperature and the oxidativeness of the propellant combustion gases.

2. A method according to claim 1 wherein said potting material is selected from the group consisting of polybutadienes, polyurethanes, polyesters and polysulfides and wherein said solid rocket propellant is selected from the group of composite solid rocket propellants utilizing a material selected from the group consisting of polybutadienes, polyurethanes, polyesters, polysulfides, or nitroglycerin-nitrocellulose mixtures as a binder, a material selected from the group consisting of ammonium perchlorate, ammonium nitrate, cyclotetramethylenetetranitramine (HMX) or cyclotrimethylenetrinitramine (RDX) as an oxidizer, and optionally a material selected from the group consisting of aluminum, magnesium, and carbon as a fuel.

3. A method according to claim 2 wherein said pieces of solid rocket propellant are in the geometrical form of sheets, slabs or strands.

* * * * *